United States Patent [19]

Beard

[11] Patent Number: 4,925,334

[45] Date of Patent: May 15, 1990

[54] TRAFFIC MARKER WITH HANGER

[76] Inventor: James R. Beard, 400 Palm Valley Dr. West, Harlingen, Tex. 78552

[21] Appl. No.: 355,721

[22] Filed: May 17, 1989

[51] Int. Cl.[5] ..... E01F 9/10

[52] U.S. Cl. ..... 404/9; 116/63 C

[58] Field of Search ..... 404/9, 10; 116/63 P, 116/63 C; 40/606, 608, 610, 612

[56] References Cited

U.S. PATENT DOCUMENTS 3,732,842 5/1973 Vara, Sr. ..... 116/63 P

FOREIGN PATENT DOCUMENTS 2587050 3/1987 France ..... 404/9

2182701 5/1987 United Kingdom ..... 116/63 C

*Primary Examiner*—Jerome Massie, IV

*Assistant Examiner*—Matthew Smith

[57] ABSTRACT

A traffic marker includes an upright cone-shaped member (10) and a base (16). Two orifices (18) and (26) are provided on the upper end of the cone-shaped member (10) and on opposite sides thereof. A bracket (20) is provided having an interior portion (30) and an exterior portion (28). The bracket is operable to be inserted through the orifice (26) such that the distal end of the interior portion (30) contacts the interior surface of the cone-shaped member (10) at a point (38). An orifice (34) is disposed in the interior member (30) through which a flag (24) can be inserted. The flag (24) is inserted through the orifice (18) on the opposite side of the cone-shape member (10) through the orifice (34) to contact the opposite sides of the interior surface of the cone (10) at a point (36).

12 Claims, 2 Drawing Sheets

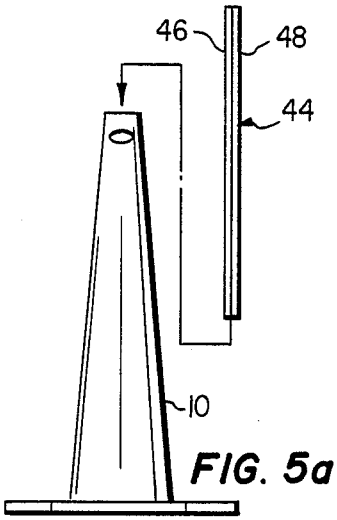
FIG. 5a
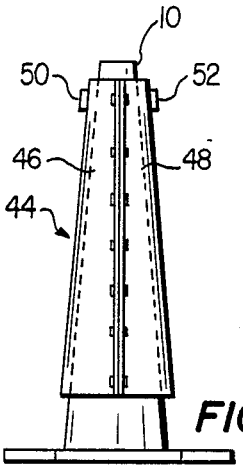
FIG. 5b
FIG. 5c
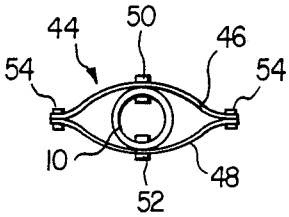
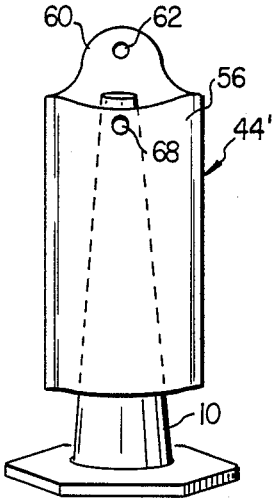
FIG. 6
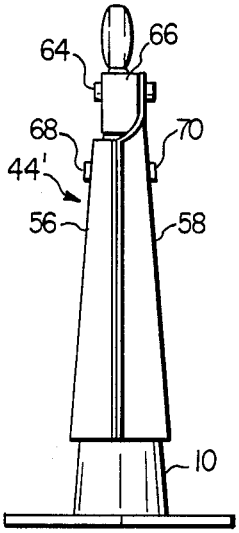
FIG. 7
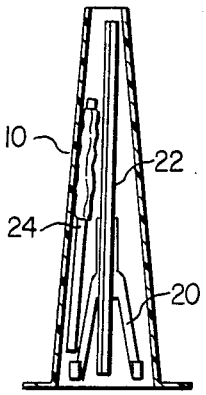
FIG. 8
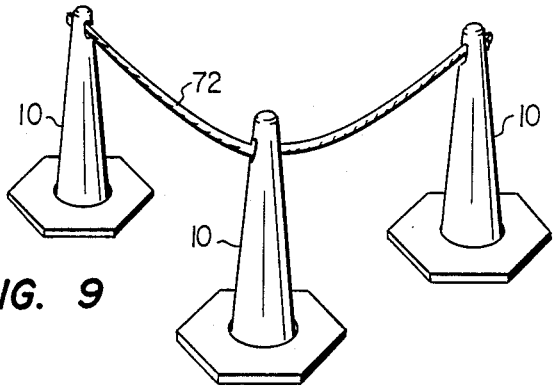
FIG. 9

TRAFFIC MARKER WITH HANGER

TECHNICAL FIELD OF THE INVENTION

The present invention pertains in general to a traffic marker, and more particularly, to a molded traffic marker having a sign movably attached thereto.

BACKGROUND OF THE INVENTION

Traffic markers are utilized in general on construction sites, roadsides, etc., to provide some type of warning to a motorist that a portion of the road is impassible and should be avoided. These traffic markers typically are comprised of an upright member that is brightly colored. In addition, these markers are utilized to hold signs or flags.

The present markers are typically comprised of an upright wooden member with a sand bag provided on the base to hold the marker in place. Other types of markers are the molded cone type markers that have a hole in the top portion for inserting items such as flags, etc. therein. These cone type markers are the preferred markers since they stack on top of one another and are relatively inexpensive. The disadvantage to present day cone type markers is that they lack versatility. On present job sites, cone type markers are utilized to define a boundary, whereas a separate supporting device is utilized for signs and the such. Additionally, if a roped off boundary is provided, additional upright members are provided for this.

SUMMARY OF THE INVENTION

The present invention disclosed and claimed herein comprises a traffic marker. The traffic marker consists of an upright support member which has at least a front panel and a back panel disposed essentially parallel to each other. The front panel has a substantially horizontal supporting edge disposed thereon and the rear panel has a substantially horizontal supporting edge disposed thereon. A support bracket is provided which has an interior portion and an exterior portion. The interior portion is disposed at an angle with respect to the exterior portion, both being joined at a junction, the junction operable to be disposed proximate to the supporting edge on the front panel. The interior portion has an orifice disposed therein. A longitudinal member is provided for being inserted through the orifice in the interior portion and downward to contact the interior surface of the upright support member with one surface thereof adjacent to the supporting edge on the rear panel. The exterior portion of the bracket comprises a holding member for supporting a sign or the such.

In another embodiment of the present invention, the upright support member is cone-shaped with a hollow interior and first and second orifices disposed on the upper end thereof and on opposite sides. The peripheral edge of the first and second orifices comprises the substantially horizontal supporting edges on the front and rear panels, respectively. The interior portion of the support bracket is essentially longitudinal and flat in shape with the orifice disposed therein. The interior portion is comprised of a first portion which is a substantially horizontal member and a second portion which is a rear restraining member disposed at an angle with respect to the horizontal member. The distal end of the rear restraining member is operable to contact the interior surface of the cone-shaped member when the holding member is disposed at an angle adjacent the exterior surface of the cone-shaped member.

In yet another aspect of the present invention, a collar is provided for being disposed downward over the cone-shaped member in lieu of the supporting bracket. The collar is comprised of two flexible flat and rectangular surfaces that are fixedly attached to each other on two opposite parallel sides such that an opening can be formed when the central portions of the two flat surfaces are pulled away from each other. Orifices are disposed at a common end on each of the first and second flat surfaces midway between the corners thereof. Mating holes corresponding to the two orifices on the flat surfaces are disposed on the upper end of the cone-shaped member with first and second bolts provided for holding the flat surfaces to the cone-shaped member when expanded to form a collar. The collar has markings thereon for providing warnings.

BRIEF DESCRIPTION OF THE DRAWINGS

For a more complete understanding of the present invention and the advantages thereof, reference is now made to the following description taken in conjunction with the accompanying Drawings in which:

FIGS. 5*a*–5*c* illustrate an alternate embodiment of the present invention with an exterior marking sheath that can be inserted over the top of the cone type marker of the present invention;

FIG. 6 illustrates an alternate embodiment of the marker of FIGS. 5*a*–5*c;*

FIG. 7 illustrates a side view of the marker of FIG. 6;

FIG. 8 illustrates a cut-away view of the marker of FIGS. 1–4, illustrating the storage feature thereof; and FIG. 9 illustrates an alternate use for the marker of FIGS. 1–4.

DETAILED DESCRIPTION OF THE INVENTION

Figure 1:
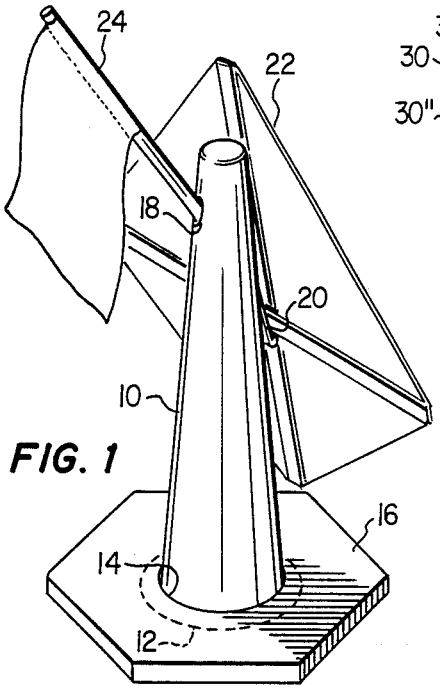
FIG. 1 illustrates a perspective view of the traffic marker of the present invention.

FIG. 1 illustrates a perspective view of the traffic marker of the present invention. The traffic marker is configured of a cone-shaped upright member 10 having a hollow interior. The lower end of the upright member 10 is flanged at the lower end thereof as represented by a phantom outline 12. The upright member 10 inserts through an orifice 14 in the center of a base plate 16 from the bottom surface thereof such that the flange 12 contacts the bottom surface of the base plate 16. The upright member 10 is manufactured by molding polypropylene the like with either injection molding techniques or any other suitable molding technique such as blow molding or rota-molding to provide a relatively lightweight, hollow member.

The upright member 10 has an orifice 18 disposed in the rear surface thereof and another orifice (not shown) disposed on the opposite side. A bracket 20 is disposed in the orifice (not shown) disposed opposite to the orifice 18 such that it extends into the hollow interior of the upright member 10. A flag 22 or similar type display device is disposed on the bracket 20 and a flag 24 is disposed through the orifice 18 to contact the bracket 20 in the interior of the upright member 10, as will be described in more detail hereinbelow.

Figure 2A:
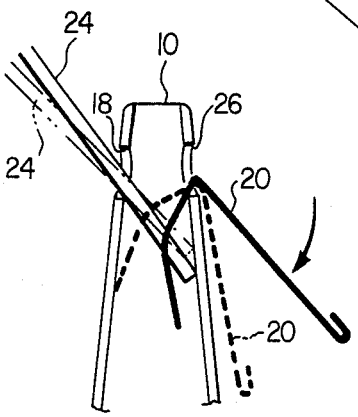
FIGS. 2 and 2*a* illustrate a cross-sectional diagram of the present invention.
Figure 2:
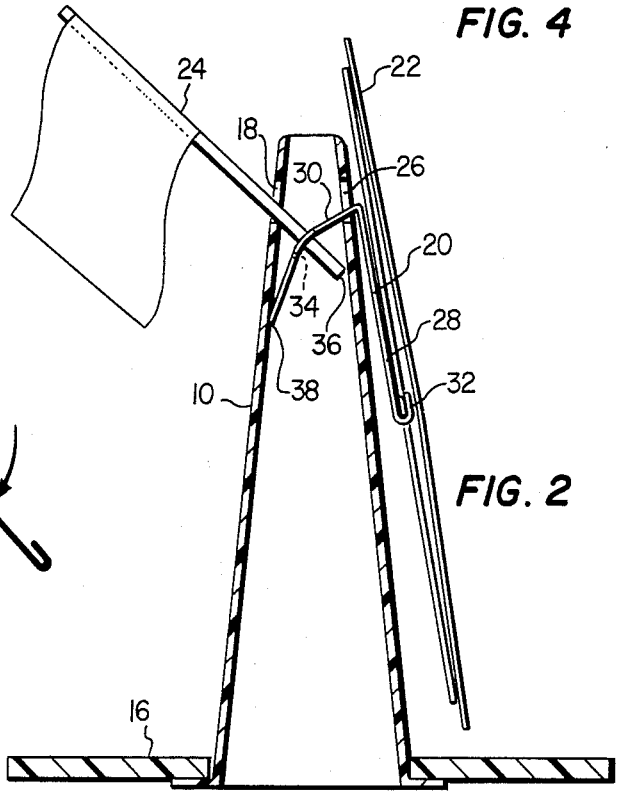

Referring now to FIG. 2, there is illustrated a cross-sectional diagram of the upright member 10 and base 16. The orifice, not shown in FIG. 1 and disposed on the opposite side of the upright member 10 from the orifice 18, is referred to by the reference numeral 26. The bracket 20 is comprised of two portions, an exterior portion 28 and an interior portion 30. The exterior portion 28 has grasping members 32 disposed on the lower ends thereof for interfacing with the flag 22. The portion 30 is disposed at an angle with respect to the portion 28 such that the portion 28 lies proximate to the exterior surface of the upright member 10 below the orifice 26. The junction of the portions 28 and 30 lies on the lower edge of the orifice 26 with a portion 30 extending inward to the hollow interior of the upright member 10.

An orifice 34 is formed through the surface of the interior portion 30, which orifice is operable to receive the lower end of the flag 24. The flag 24 is operable to be disposed through the orifice 18 and through the orifice 34 in the portion 30. If the flag 24 is inserted into the orifice 18 as far as possible, it will contact the interior surface of the upright member 10 at a point 36. As illustrated in FIG. 2, the end of the interior portion 30 of the bracket 20 also contacts the interior surface of the upright member 10 at a point 38. However, it should be understood that the interior portion 30 need not be long enough to contact the interior surface of the upright member 10 opposite to the orifice 26, nor does the end of the flag 24 need contact the interior surface of the member 10. Rather, the bracket is inserted such that the exterior member 28 is positioned outward from the surface of the upright member 10 to rotate the interior portion 30 downward to the interior surface of the upright member 10 on the same side as the orifice 26. Once the flag 24 is inserted into the orifice 24 in the interior portion 30, the exterior portion 28 is rotated downward toward the surface of the upright member 10 to provide a locking action. This is illustrated schematically in FIG. 2a wherein the solid line represents the position of the flag 24 and the bracket 20 initial position, and the phantom lines illustrate the final position.

Figure 3A:
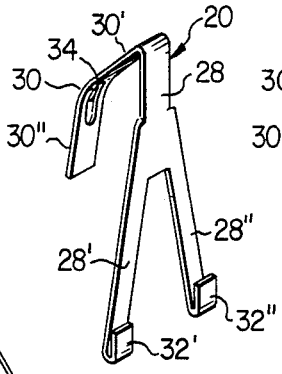
FIGS. 3*a* and 3*b* illustrate the hanger utilized to hold the sign.
Figure 3B:
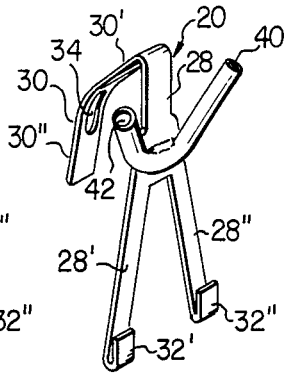

Referring now to FIGS. 3*a* and 3*b*, there is illustrated a detailed outline of the bracket 20. In FIG. 3*a*, the exterior portion 28 is comprised of a downward extending member and two flared portions 28′ and 28″. On the end of each of the flared portions 28′ and 28″ are two hooklike members 32′ and 32″ which correspond to the grasping member 32 of FIG. 2. The hooklike members 32′ and 32″ provide two functions. As they are flared at, for example, a 45° angle with respect to the downward portion of the exterior portion 28, they provide a means by which a longitudinal member can rest therein. This longitudinal member can be, for example, the supporting ribs of flag 24. Further, they can support a rectangular shaped signed on the lower edges thereof.

The interior portion 30 is comprised of two portions, a portion 30′ having the orifice 34 disposed therein and joined at one end thereof to the exterior portion 20 and a portion 30″ which is connected to the opposite end of the portion 30′ disposed at an angle thereto. The portion 30″ is operable to provide some structural integrity and also to contact the opposite side of the interior surface of the upright member 10 from the orifice 26. However, it should be understood that the angle between the interior portion 30 and the exterior portion 28 can be varied by bending the bracket to form a relatively tight fit. For example, rather than inserting the flag 24 into the orifice 34 as illustrated in FIG. 2*a*, the angle between the interior portion 30 and the exterior portion 28 can be constructed such that the angle between the interior portion 30 and the exterior portion 28 results in the interior portion 30 contacting the interior surface of the upright member 10 while the distal end of the exterior portion 28 is disposed outward a short distance from the exterior surface of the upright member 10. The flag 24 is then inserted through the orifice 18 and the orifice 34 until it contacts the interior surface of the upright member 10 at the point 36. The flag 24 is then forced downward into the interior of the upright member 10 to provide a force upward on the upper edge of the orifice 18 and a force downward on the interior portion 30, noting that the contact of the distal end of the flag 24 at the point 36 results in a "wedging" effect.

An alternate embodiment of the bracket 20 is illustrated in FIG. 3*b*. In the structure of FIG. 3*b*, two flag holders 40 and 42 are disposed on the downward extending surface of the exterior portion 28 of the bracket 20 and disposed outward at an angle thereto. These are operable to hold the ends of flags (not shown).

Figure 4:
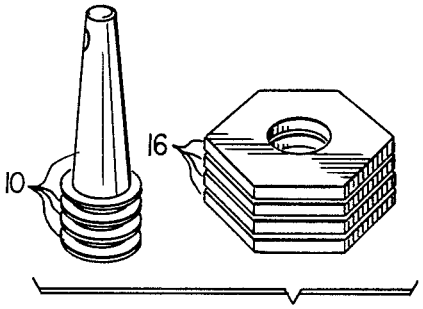
FIG. 4 illustrates the stacking operation for the markers of the present invention.

Referring now to FIG. 4, there is illustrated the mounting configuration of the upright member 10 and the base plates 16 when shipped. Each of the upright members 10 stack on top of one another whereas each of the base plates 16 is also configured to be stacked on top of each other. In this manner, the hollow members 10 provide a much more compact shipping configuration.

The base 16 is illustrated as being a solid member with a thickness of approximately one inch. When stacked, the traffic markers are configured such that the bases 16 are adjacent. This is the result of the orifices 18 that function both as handles and also as receptacles for flags and the such. Prior systems with handles would not stack in the same way which is a significant disadvantage in the prior art systems. As an alternate method for fabricating the base, a hollow member filled with sand can be utilized. However, the solid base configuration is preferred since this type of base survives a "hit" on the roadway by vehicles such as trucks and the such. Further, some municipalities do not allow sand filled bases as the sand may spread across the roadway if the marker is struck by a vehicle.

Referring now to FIGS. 5*a*–5*c*, there is illustrated an alternate embodiment of the present invention. The upright member 10 has a collar 44 disposed thereover. In FIG. 5*a*, it can be seen that the collar 44 is configured of a first half 46 and a second half 48. Each of the first and second halves 46 and 48 are comprised of a semi-rigid plastic material such that when they are in the relaxed state they are planar in nature and are in a parallel configuration. When inserted downward over the upright member 10, the central portions thereof expand as the peripheral edges are riveted together on two sides thereof, the top and bottom edges being non-riveted. When the central portions thereof are separated, an opening is formed between the halves 46 and 48 to receive the upright member 10. The collar 44 is slipped down over the upright member 10 to a predefined position and then a bolt 50 disposed through the upper portion of the side 46 and into a corresponding hole in the surface of the upright member 10 and a bolt 52 is disposed through a hole in the side 48 and through a corresponding hole in the surface of the upright member 10. The surface of the sides 46 and 48 have a suitable warning marking such as an orange stripe disposed thereacross, which stripe can be reflective in nature. A top view of the configuration of FIG. 5*b* is illustrated in FIG. 5*c* showing rivets 54 along the sides of the collar 44.

Referring now to FIG. 6, there is illustrated an alternate embodiment of the collar 44, illustrating a collar 44'. Collar 44' has a first side 56 and a second side 58, as best illustrated in FIG. 7, which is a side view of the structure of FIG. 6. The collar 44' is disposed downward over the upright member 10 as illustrated in FIGS. 5*a*–5*c*, the primary difference being that an upward protruding portion 60 is provided on the side 58. The sides 56 and 58 are riveted together similar to sides 46 and 48 in FIG. 5*a*. The upward extending portion 60 has an orifice 62 disposed therein which is operable to receive a bolt 64 which holds a warning lamp 66. Warning lamp 66 is of the type having a battery and a flashing light disposed on the upper surface thereof, this being a conventional configuration. The side 56 is held onto the upright member 10 by a bolt 68 and the side 58 is held onto the upright member 10 by a bolt 70.

Referring now to FIG. 8, there is illustrated a cross-sectional view of the structure of FIGS. 1–2 wherein the bracket 20, the flag 24 and the sign 22 are rolled up and disposed in the interior of the upright member 10. The sign 22 is of the mesh type which can be dismantled and rolled up. With this configuration, all of the necessary equipment for a marker can be stored in a relatively compact manner.

Referring now to FIG. 9, there is illustrated an example of one application of the upright markers without the collar or the support member. In this application, the orifices 18 and 26 in the upper end of the upright member 10 are utilized to string a rope 72 therethrough to form a border. In this manner, an additional element of versatility is provided by the upright members 10.

Although the preferred embodiment has been described in detail, it should be understood that various changes, substitutions and alterations can be made therein without departing from the spirit and scope of the invention as defined by the appended claims.

I claim:

1. A traffic marker, comprising:

an upright support member having a front panel and a rear panel disposed essentially parallel to each other;

said front panel having a substantially horizontal supporting edge;

said rear panel having a substantially horizontal supporting edge;

a support bracket having:

an internal member with first and second ends with an orifice formed therein, a holding member having first and second ends with the first end thereof connected to the first end of said internal member at a junction such that said internal member is disposed at an angle with respect to said holding member and said junction is operable to be disposed proximate to said substantially horizontal supporting edge on said front panel; and a longitudinal pin member for being inserted through the orifice in said internal member and having one end thereof contacting the interior surface of said front panel and the surface thereof contacting a substantially horizontal surface on said rear panel.

2. The traffic marker of claim 1 wherein said internal member is comprised of:

a horizontal member having a portion thereof comprised of a substantially flat surface with the orifice formed therein, said horizontal member having first and second ends with the first end thereof connected to said holding member at said junction; and a rear restraining member having first and second ends with the first end thereof connected to the second end of said horizontal member and extending downward therefrom at an angle thereto;

said horizontal member operable to be positioned such that the second end of said rear restraining member contacts the interior surface of said rear panel and said holding member is proximate to the exterior surface of said front panel.

3. The traffic marker of claim 1 wherein said upright support member is cone-shaped with a hollow interior.

4. The traffic marker of claim 1 wherein the plane of said front panel and the plane of said rear panel are disposed at angles with respect to the vertical such that they taper downward and outward from each other.

5. The traffic marker of claim 1 wherein:

said front panel has an orifice disposed therein with the peripheral edge of said orifice forming said substantially horizontal supporting edge; and said rear panel has an orifice formed therein at the upper end thereof with the peripheral edge of said orifice forming said substantially horizontal supporting edge.

6. The traffic marker of claim 1 and further comprising a base member for being disposed at the lower end of said upright support member and flaring outward from the surface thereof to provide support to prevent rotational movement of said upright support member about the longitudinal axis.

7. The traffic marker of claim 1 wherein said longitudinal pin member comprises a flag having a longitudinal support and a fabric-like flag.

8. The traffic marker of claim 1 and further comprising at least one cylindrical flag holder disposed on the surface of said holding member and operable to receive and hold a flag.

9. The traffic marker of claim 1 wherein said holding member comprises:

a longitudinal member having first and second ends with said first end connected to said interior member at said junction; and a supporting bracket for holding a display member, said supporting bracket connected to the second end of said longitudinal member.

10. The traffic marker of claim 1 wherein said holding member comprises;

a longitudinal flat member having first and second ends with said first end connected to said internal member at said junction;

first and second flaring members having respective first and second ends with the respective first ends thereof connected at a Y-junction to said second end of said longitudinal flat member and flaring outward therefrom; and first and second hook members connected respectively to said second ends of said first and second flaring members and disposed in a plane that is substantially perpendicular to the longitudinal axis of said upright support member.

11. A traffic marker, comprising:

an upright support member having a substantially conical shape;

a collar comprising:

a first substantially flat portion, rectangular in shape and flexible, a second substantially flat surface, rectangular in shape and flexible, attachment means for attaching the peripheral edges of said first flat portion to said second flat portion on opposite sides thereof such that two parallel sides of said first and second flat surfaces are connected, said attached first and second flat portions operable to form an opening therebetween for inserting downward over said upright support member, said first and second flat portions each having a hole disposed at one common end thereof on the side not attached together and disposed midway between the corners thereof;

said upright support member having two holes on opposite sides thereof and disposed on the upper end thereof for mating with holes in the ends of said first and second flat portions; and first and second bolts for being connected through the holes in said first and second flat surfaces and through the corresponding mating holes in the upper end of said upright support member for attaching said first and second flat surfaces thereto.

12. The traffic marker of claim 11 and further comprising:

an extended portion attached to said second flat surface on the end thereof with the hole disposed therein corresponding to the upper end of said upright support member such that said extended portion extends upward from said upright support member relative to the end of said first flat surface;

said extended portion having a hole formed therein; and a third bolt for being disposed through a hole in a separate lighting member to the hole in said extended portion for attachment thereto.

* * * * *